US008558844B2

(12) United States Patent
Goossens

(10) Patent No.: US 8,558,844 B2
(45) Date of Patent: Oct. 15, 2013

(54) SYSTEMS, METHODS, AND COMPUTER-READABLE MEDIA FOR CHANGING COLORS OF DISPLAYED ASSETS

(75) Inventor: Thomas Goossens, Paris (FR)

(73) Assignee: Apple Inc., Cupertino, CA (US)

( * ) Notice: Subject to any disclaimer, the term of this patent is extended or adjusted under 35 U.S.C. 154(b) by 613 days.

(21) Appl. No.: 12/892,624

(22) Filed: Sep. 28, 2010

(65) Prior Publication Data

US 2012/0075328 A1 Mar. 29, 2012

(51) Int. Cl.
*G09G 5/02* (2006.01)

(52) U.S. Cl.
USPC ..... 345/600

(58) Field of Classification Search
USPC ..... 345/589–605
See application file for complete search history.

(56) References Cited

U.S. PATENT DOCUMENTS

| | | | | |
|---|---|---|---|---|
| 5,317,678 | A | 5/1994 | Okawara et al. | |
| 5,867,169 | A * | 2/1999 | Prater | 345/604 |
| 6,928,187 | B2 * | 8/2005 | Cooper et al. | 382/167 |
| 7,242,409 | B2 | 7/2007 | Cain | |
| 7,573,487 | B1 | 8/2009 | Petersen | |
| 8,218,860 | B1 * | 7/2012 | Berger et al. | 382/162 |
| 2007/0121180 | A1 | 5/2007 | Ogawa | |

* cited by examiner

*Primary Examiner* — Aaron M Richer
*Assistant Examiner* — Mohammad H Akhavannik
(74) *Attorney, Agent, or Firm* — Wong, Cabello, Lutsch, Rutherford & Brucculeri, LLP

(57) ABSTRACT

Systems, methods, and computer-readable media are provided for changing a color of an asset used as part of a displayed avatar from an initial color to an destination color. An indexed color can be defined for the asset, where initial colors of the asset that are sufficiently similar to the indexed color can be changed to replacement colors. In particular, the replacement colors can include gradients or other optical effects that may be similar to those of the initial colors. A model encoding color information for each pixel of an asset can include a color index indicating whether the color of the pixel is changeable. In some cases, the model for a particular pixel may be converted from a RGB model to a HSV model for reducing the processing that may be required to define replacement colors when a selection of a destination color is received.

20 Claims, 13 Drawing Sheets
(6 of 13 Drawing Sheet(s) Filed in Color)

800

| 810 | 812 | 814 | 816 | 818 |
|---|---|---|---|---|
| Component | R | G | B | A |
| bits (32 total) | 8 | 8 | 8 | 8 |
| 820 | 822 | 824 | 826 | 828 |

FIG. 8

900

| 910 | 912 | 914 | 916 | 918 |
|---|---|---|---|---|
| Component | H | S | V | A |
| bits (32 total) | 8 | 8 | 8 | 8 |
| 920 | 922 | 924 | 926 | 928 |

FIG. 9

1000

| 1010 | 1012 | 1014 | 1016 | 1018 | 1019 |
|---|---|---|---|---|---|
| Component | R | G | B | A | Color Index |
| bits (24 total) | 5 | 6 | 5 | 6 | 2 |
| 1020 | 1022 | 1024 | 1026 | 1028 | 1029 |

FIG. 10

1100

| Color index (1110) | Meaning (1120) |
|---|---|
| 0 0 (1112) | Not color editable (1122) |
| 0 1 (1114) | Color depends on first indexed color (1124) |
| 1 0 (1116) | Color depends on second indexed color (1126) |
| 1 1 (1118) | Color depends on skin color (1128) |

FIG. 11

1200

$$P(H, S, V) = (Hd, Sp*Sd, Sp*(Vp*Vd)+(1-Sp)*Vp)$$

FIG. 12

| 1310 | 1312 | 1314 | 1316 | 1318 |
|---|---|---|---|---|
| Component | V | A | S | Color Index |
| bits (24 total) | 8 | 8 | 6 | 2 |
| 1320 | 1322 | 1324 | 1326 | 1328 |

SYSTEMS, METHODS, AND COMPUTER-READABLE MEDIA FOR CHANGING COLORS OF DISPLAYED ASSETS

BACKGROUND

Some electronic devices can display three-dimensional models that a user can control as part of an electronic device operation. For example, gaming consoles can display avatars that represent a user, and the user can direct the avatar to perform specific actions in the game. The avatars can be constructed from the combination of assets such as a body, a head, eyes, ears, nose, and hair. To enhance the user's gaming experience, a user can personalize the avatar by selecting specific assets. The user can further personalize the avatar by changing colors of specific assets. The displayed avatar, however, is typically colored using a color palette by which a color of the palette is associated with each pixel of the avatar. Because palettes typically are limited in size (e.g., 256 colors), the palettes may not allow for progressive transparency or gradients in color. In addition, there is no easy approach for uniformly changing a range of colors to a new range of colors.

SUMMARY

Systems, methods, and computer-readable media for changing colors of displayed assets are provided.

An electronic device can display a three-dimensional model, such as an avatar. The avatar can be constructed from several assets, each of which can have several colors. In particular, an asset can include variations of colors (e.g., gradients, or blended colors) that provide an aesthetically pleasing avatar. To personalize an avatar, a user can select and change some of the displayed colors of individual assets. For example, a user may wish to change a first or indexed color of an asset to a second or destination color.

However, in order to maintain the aesthetically pleasing color gradients of the asset, this change may include not only changing the indexed color to the destination color, but may also include changing each individual color of an initial color gradient associated with the indexed color to a new, replacement color of a different color gradient associated with the destination color.

The electronic device may first identify the particular colors of the asset that are part of the initial gradient and that should change in response to a corresponding user instruction to change a color of the initial gradient to a destination color. When an asset is defined (e.g., created by an artist for later use by a user to create a personalized avatar), one or specific colors of the asset may be identified as an indexed color that may be selected by a user for a color changing operation. In addition, an index threshold may be defined for each indexed color that may describe a range of colors relative to the indexed color (e.g., a color gradient or a color similarity associated with the indexed color). Then, other colors of the asset that are within the range defined by the index threshold of an indexed color may be identified as colors that may also be changed along with that indexed color (e.g., to maintain the aesthetically pleasing color gradients of the asset).

To efficiently change these identified colors when a user wishes to change an indexed color of an asset, the encoding of each asset pixel having one of the identified colors can be modified. In particular, the encoding of each pixel can include a color index that may indicate whether the color of the pixel can be changed for a particular indexed color. The color index of a pixel can be encoded in any suitable color model including, for example, a red, green, blue (RGB) model or a hue, saturation, value (HSV) model.

Once each pixel of an asset has been encoded with a color index, the color indexes can be used to identify and change the color of appropriate pixels of the asset when a user wishes to change an indexed color of the asset to a destination color. For example, when a user selects a destination color to replace an initial indexed color of an asset, all of the pixels of the asset having a color related to the indexed color may be identified (e.g., according to the color index of each pixel). Then, a transformation may be applied to the initial color of each of the identified pixels to generate a replacement color for each of the identified pixels. Each of the replacement colors can be related to the destination color, and may provide a similar gradient or blending with respect to the destination color as the initial colors may provide with respect to the indexed color. In some embodiments, a HSV model can be used to generate the replacement colors.

BRIEF DESCRIPTION OF THE DRAWINGS

The patent or application file contains at least one drawing executed in color. Copies of this patent or patent application publication with color drawings will be provided by the U.S. Patent and Trademark Office upon request and payment of the necessary fee.

The above and other aspects of the invention, its nature, and various features will be more apparent upon consideration of the following detailed description, taken in conjunction with the accompanying drawings in which like reference characters may refer to like parts, and in which:

FIG. 8 is a schematic view of an initial illustrative data structure for storing a color of a pixel forming an asset defined by an artist in accordance with some embodiments of the invention;

FIG. 9 is a schematic view of an illustrative converted data structure for storing a color of a pixel in accordance with some embodiments of the invention;

FIG. 10 is a schematic view of an illustrative data structure having a color index in accordance with some embodiments of the invention;

FIG. 11 is an illustrative table indicating the meaning of color index values in accordance with some embodiments of the invention;

FIG. 12 is an illustrative equation for defining replacement colors for pixels having changeable colors in accordance with some embodiments of the invention;

DETAILED DESCRIPTION

Systems, methods, and computer-readable media for changing colors of displayed assets are provided and described with reference to FIGS. 1-19.

An electronic device can display an avatar constructed from several assets. Each asset can include several colors. To enhance the appearance of the assets, the assets can include color gradients or other variations of similar colors that provide a more realistic or complex appearance. To personalize the avatar, a user can change particular colors of one or more assets. In some cases, an asset can have a limited number of colors that can be changed. These colors may be referred to as indexed colors. When the asset includes color gradients that are similar to an indexed color, however, it may be necessary to change a collection of related or similar colors, rather than just changing a single indexed color (e.g., in order to maintain the detail of the asset).

Each pixel of an asset can be encoded using a model representing a color. The model can include a color index identifying a particular indexed color with which the color of the pixel may be related. Then, when a user provides an instruction to change a selected indexed color to a destination color, each pixel of the asset having a color index corresponding to the selected indexed color can be changed.

To maintain gradients of an asset when an indexed color is changed to a destination color, an initial color of each pixel having a color index corresponding to an indexed color can be replaced with a replacement color having similar properties to the initial color. In particular, each replacement color can be similar to the destination color, but may have variations corresponding to a gradient of the initial color.

Figure 1:
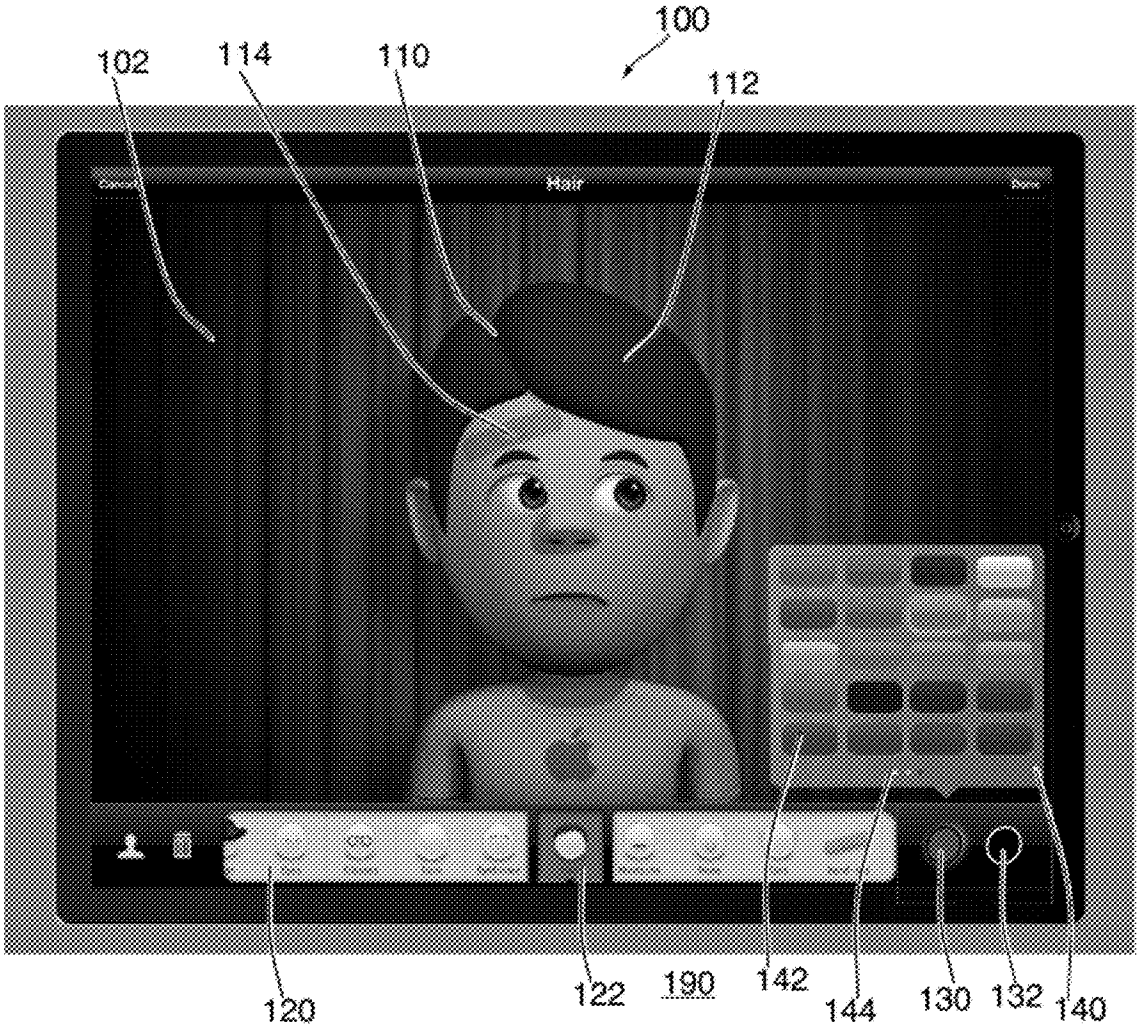
FIG. 1 is an illustrative display of an avatar constructed from several assets and displayed by an electronic device in accordance with some embodiments of the invention.

An electronic device can display different content for enjoyment by a user. In some cases, an electronic device can display an avatar as part of an application operating on the device. FIG. 1 is an illustrative display of an electronic device 190 for displaying an avatar in accordance with some embodiments of the invention. Display 100 can include avatar 110 provided in front of background 102. Avatar 110 can represent any suitable object including, for example, a person, an animal, a place, or a thing (e.g., an imaginary being). A user can create avatar 110 by selecting assets from asset bar 120, and positioning specific assets on the avatar. The assets can include, for example, a face, mouth, eyes, ears, nose, mustache, beard, hair, eyebrows, glasses, hats, accessories (e.g., jewelry or band-aids), clothing, or other components that can be included on an avatar. The assets can be provided from a source of assets (e.g., a library of assets stored locally or remotely from electronic device 190).

When a user selects an asset on asset bar 120 such as, for example, hair asset 122, the device can display a menu or listing of one or more different hair options (not shown) that may be selected as the hair to provide on avatar 110. The user can select one of the hair options to be applied to the avatar. A user can select any suitable number of options associated with a single asset to place on an avatar. For example, a user can select to place several nose options on an avatar. In some cases, however, the electronic device can replace a previously selected option placed on an avatar with a newly selected option for an asset (e.g., to ensure that an avatar only includes one mouth).

Figure 2A:
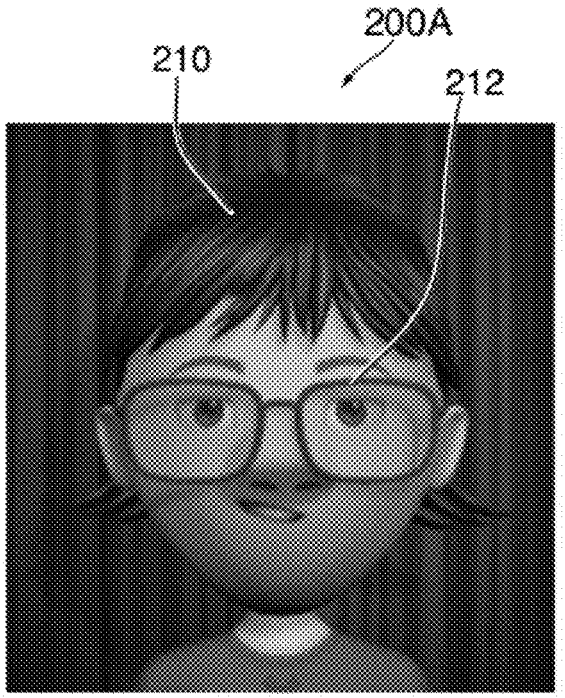
FIGS. 2A and 2B are illustrative views of an avatar constructed from several assets and displayed by an electronic device in accordance with some embodiments of the invention.
Figure 2B:
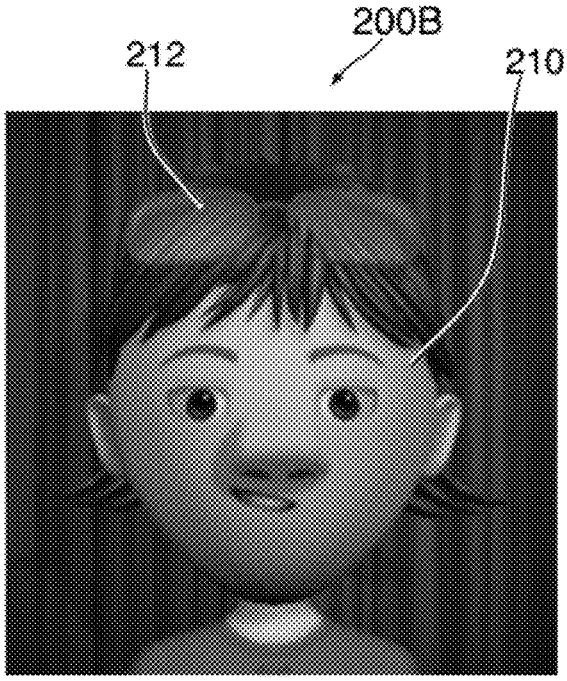

In some embodiments, different assets can be moved on an avatar. For example, a user can select an asset, and displace it on or in the external surface of the avatar. In the examples of FIGS. 2A and 2B, displays 200A and 200B of avatar 210 can include a glasses asset 212 in two different positions (e.g., on the bridge of the nose of avatar 210 of FIG. 2A, and on the forehead of avatar 210 of FIG. 2B). The user can move asset 212 using any suitable approach including, for example, by dragging the asset, or by using directional instructions (e.g., directional keys of an input interface).

In addition to selecting specific assets to include as part of an avatar, a user can select different colors for a displayed asset. With continued reference to FIG. 1, to change a color of an asset, a user can select one of color options 130 and 132 from asset bar 120. Each of color options 130 and 132 can include a representation of a color that can be changed in the particular asset currently selected in asset bar 210 (e.g., the hair asset). In the example of FIG. 1, option 130 can indicate that a user can change brown portions of the hair asset, and option 132 can indicate that the user can change black portions of the hair asset. The asset can be associated with any suitable number of color options identifying different colors that can be changed in the asset. In some cases, assets can be provided with only a limited number of changeable colors, known as indexed colors. Initially, options 130 and 132 can include representations of the indexed colors, although the representations can later change as a user personalizes the asset.

In response to receiving a user selection of a color option 130 or 132, electronic device 190 can display a menu or listing of available colors for the asset. For example, display 100 can provide pop-up menu 140 having selectable color options 142 in response to receiving a selection of color option 130. In some cases, the user can scroll through several pages of color options 142, as indicated by page marker 144. To change the color represented in the selected color option 130, a user can select one of the colors of menu 140. In response to receiving a selection of a new color, known as a destination color, for the asset, the electronic device can change the display of the asset.

Figure 3:
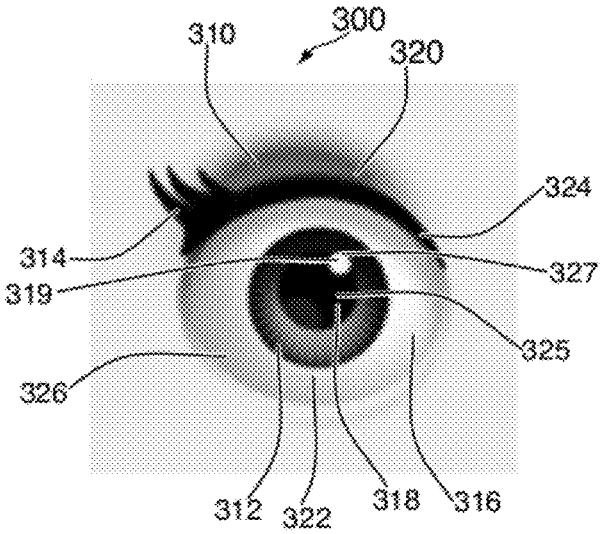
FIG. 3 is an illustrative view of an eye asset in accordance with some embodiments of the invention.

Assets can be constructed in different manners to enable a user to define a destination color for a portion of the asset. FIG. 3 is an illustrative view of an eye asset in accordance with some embodiments of the invention. Asset 300 can be selected by a user for inclusion in an avatar. Asset 300 can include several distinct elements such as, for example, eye shadow 310, iris 312, eyelash 314, sclera 316, pupil 318, and bead 319 in pupil 318. Each element of the asset can have a particular color such as purple 320 for eye shadow 310, blue 322 for iris 312, black 324 for eyelash 314, black 325 for pupil 318, gray 326 for sclera 316, and white 327 for bead 319.

To enhance the aesthetic appeal of asset 300, some or all of the colors provided by elements of the asset can include gradients or variations that reflect a more accurate depiction of the asset. For example, purple 320 can include a range of purple colors extending from a deeper purple to a lighter, pinker purple. As another example, blue 322 can include a gradient of blues that are lighter near a center of the eye, and blend towards darker blues away from the center of the eye. As still another example, gray 326 can include different shades of gray corresponding to a particular illumination of sclera 316.

Figure 4:
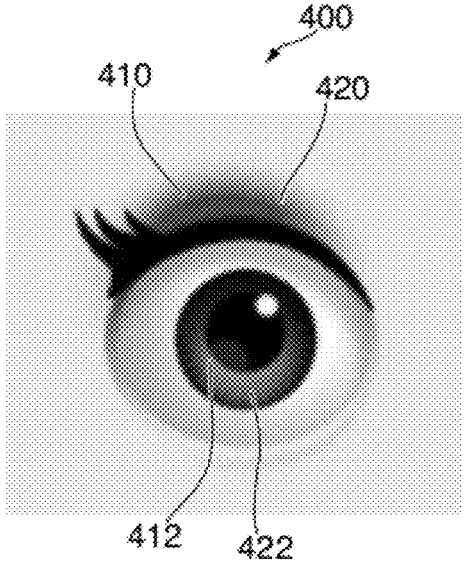
FIG. 4 is an illustrative view of another eye asset in accordance with some embodiments of the invention.

When a user changes a color of an asset, the newly displayed color can include similar variations or gradients (e.g., blending between similar colors) as an initially displayed color. FIG. 4 is an illustrative view of an eye asset similar to eye asset 300 of FIG. 3 but with different colors in accordance with some embodiments of the invention. In particular, asset 400 can include eye shadow 410 provided in red 420, and iris 412 provided in green 422. Red 420 can include a variation of red colors in which the portions of red that are lighter or darker on asset 400 correspond to the same portions of purple 320 that are lighter or darker on asset 300. In other words, the variation in red 420 of eye shadow 410 of asset 400 may mimic the variation in purple 320 of eye shadow 310 of asset 300. Similarly, green 422 of iris 412 of asset 400 can include a variation of green colors that mimics the variation in blue 322 of iris 312 of asset 300.

Figure 5:
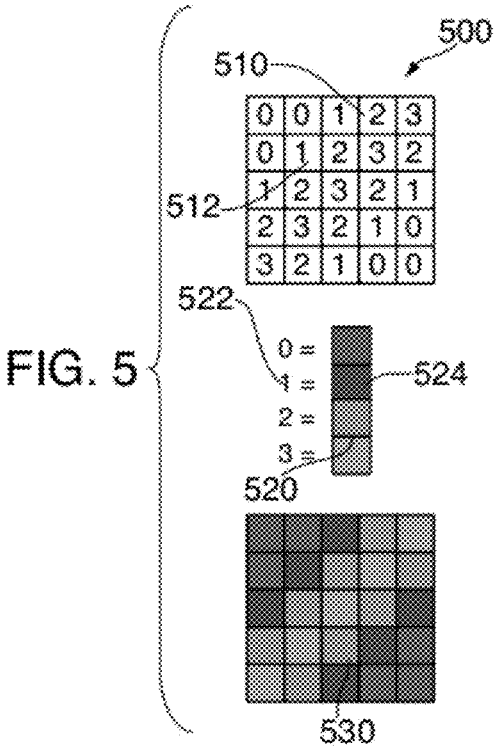
FIG. 5 is a schematic view of a palette-based approach for coloring an asset.

Several approaches can be used to encode an asset in a manner that allows an end-user to change a color of the asset. One known approach involves encoding an asset using a palette. In this approach, each pixel of the asset may be associated with a specific color selected from a palette having a limited number of colors (e.g., 256 or 512 colors). FIG. 5 is a schematic view of a palette-based approach for coloring an asset. Structure 500 can include asset 510 in which each pixel 512 of asset 510 is associated with a particular reference number. For example, each pixel can be associated with a particular reference number associated with one of the colors of a palette. In the example of asset 510, each pixel 512 is associated with a particular reference number corresponding to 4-color palette 520. Palette 520 can include reference numbers 522, each of which may correspond to a particular color 524.

Several approaches can be used to associate a specific color 524 to each pixel 512. In some cases, each reference number 522 can be a code corresponding to a particular color. In this approach, a reference number 522 always corresponds to the same color 524 (e.g., the color can be determined directly from the reference number). To change a color of a pixel 512, an electronic device can change the reference number 522 associated with the pixel. In other cases, each reference number 522 can be associated with a specific color from a collection of available colors (e.g., 0=red). In this approach, a reference number 522 may correspond to different colors based on user-defined associations of reference numbers and colors (e.g., the color is determined by making reference to palette 520). To change a color of a pixel, the electronic device can change the association of reference numbers with colors shown in palette 520.

When asset 510 is displayed, the electronic device can identify, for each pixel 512 of the asset, an associated reference number 522. Using palette 520, the electronic device can retrieve a color corresponding to each reference number 522, and display the pixels 512 using retrieved colors. The resulting displayed asset 530 can include the colors 524 selected from palette 520.

Using a palette can have some advantages. In particular, a palette can be very easy to implement, and require very few resources to display. When a user wishes to change a particular color in the asset, the color mapping of references numbers of the asset can be changed. For example, if a specific reference number of each pixel of an asset corresponds directly to a specific color, the electronic device can change the instances of a reference number to a new reference number corresponding to a new color. Alternatively, as opposed to changing the instances of the particular reference number to a new reference number, the electronic device can change the association of a particular reference number from a first color to a second color of the palette. Then, when displaying the asset, the electronic device can use the new color of the palette corresponding to the particular reference number.

Although using a palette may provide for an easy mechanism for changing colors for some assets, it may also limit the cosmetic appeal of some assets. In particular, a palette allows for easily changing a single pixel from a first color to a second color, but it may be difficult to expand a palette to change several related colors, for example as part of a gradient. In particular, it may be very difficult to change the colors of asset 300 (FIG. 3) to provide asset 400 (FIG. 4), as a palette based approach may require a user to individually identify and change each variation of purple 320 and blue 322 of asset 300 to corresponding variations of red 420 and green 420 of asset 400. This approach may be too burdensome and frustrating for the user.

Accordingly, another approach that may improve upon the palette-based approach can be used if a user is to be able to easily change variations of colors of an asset. In particular, another approach may require identifying specific pixels of an asset that have initial colors that are sufficiently similar to an indexed color to be changed. Then, after receiving a new color (e.g., a "destination color") for replacing the indexed color, the approach may require identifying replacement colors for each of the pixels having an initial color similar to the indexed color. In one implementation, this approach can use a hue, saturation, value (HSV) model for pixels of the asset to identify the initial colors that may change with an indexed color. In the HSV model, the hue of a color may closely corresponds to a color perceived by a user, and can therefore be more easily manipulated than a standard red, green, blue (RGB) model. In particular, a user can easily pick a color directly from a hue, while picking a color using a RGB model can require a user specifying individual values for red, green and blue components, which is a non-intuitive approach.

Figure 6:
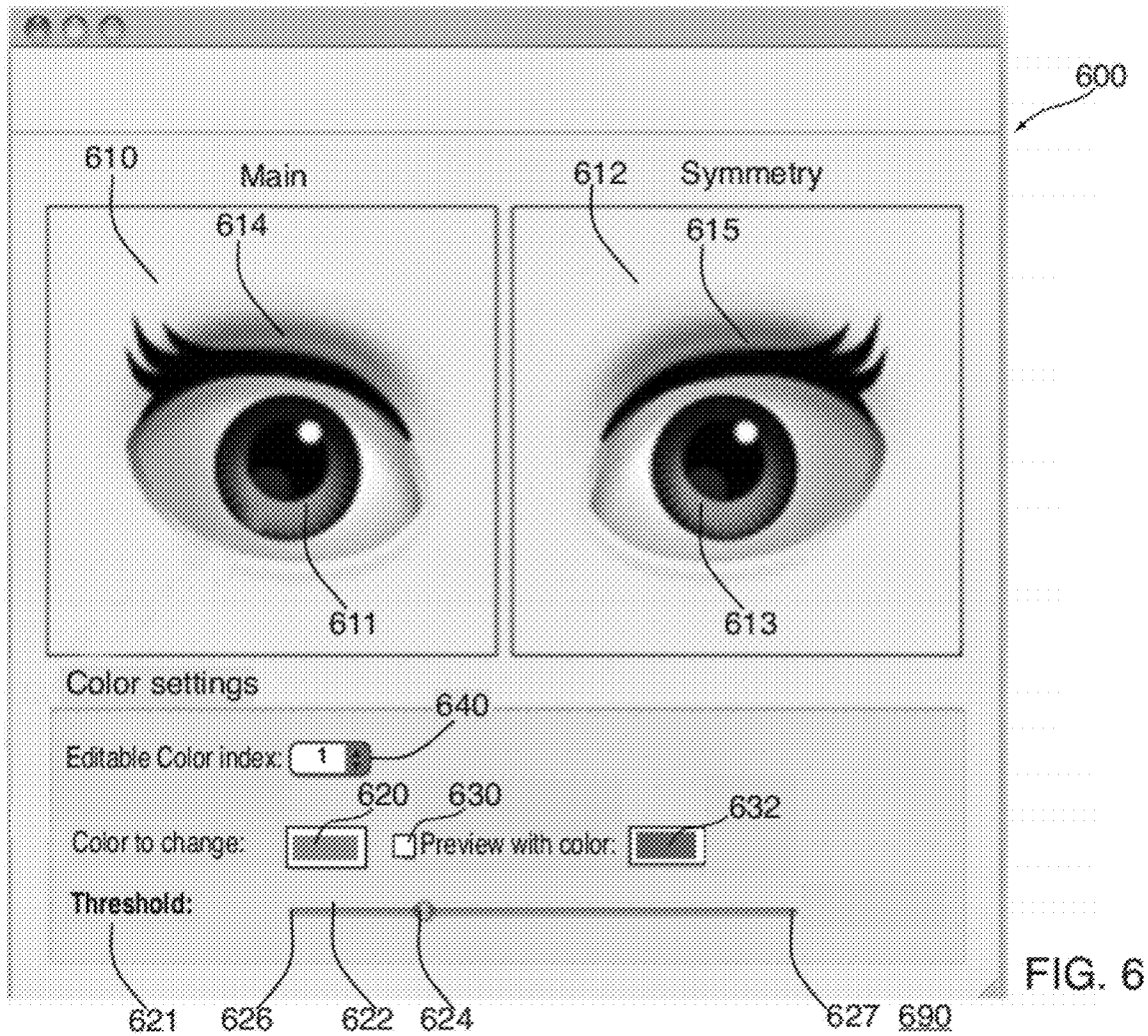
FIG. 6 is an illustrative display of an electronic device interface for defining colors of an asset that can change in accordance with some embodiments of the invention.

FIG. 6 is an illustrative display of an interface of electronic device 690 for defining the colors of an asset that can change in accordance with some embodiments of the invention. Display 600 can include asset 610 and corresponding symmetrical asset 612. In some cases, asset 612 may not be provided, for example for assets for which only a single asset is included on an avatar (e.g., hair or a mouth). Typically, constraints set for asset 610 can be automatically applied to asset 612.

To allow a user to personalize an asset, one or more changeable indexed colors can be defined for the asset. In particular, an artist creating assets 610 and 612 for use by a user in an avatar can define the changeable indexed colors of the asset. In one implementation, the artist can select a specific indexed color using option 620. In response to receiving a selection of option 620, electronic device 690 can display a menu or other representation of colors from which the artist can select an indexed color. In some cases, the selectable indexed colors can be limited to colors present in asset 610. In the example of display 600, an artist may have elected to allow users to change a color of iris 611 and iris 613 (e.g., the colors of the irises are the same as the indexed color indicated by option 620).

In contrast with a palette-based approach, in which only a single color can be changed at a time, display 600 can include a variable index threshold 621 that may allow an artist to define a range of colors relative to the indexed color of option 620 that may be changeable by a user along with the indexed color. In particular, the magnitude or value of the threshold 621 can define a similarity of colors relative to the indexed color, where sufficiently similar colors are changed with the indexed color. For example, the artist can move slider 624 on bar 622 to set a value of threshold 621. If slider 624 is placed on left-most edge 626 of bar 622 (e.g., if a the value of threshold 621 is set at its lowest magnitude), electronic device 690 may only change the color of pixels that match the exact indexed color selected by option 620. Alternatively, if slider 624 is placed on right-most edge 627 of bar 622 (e.g., if the value of threshold 621 is set at its highest magnitude), electronic device 690 can change the color of every pixel of the asset. It is to be understood that the magnitude of threshold 621 can be varied in any suitable manner other than with a slider. For example, the magnitude of threshold 21 can be manually entered. In some cases, the magnitude of the value of threshold 621 can correspond to a variation in hue value of a color of the asset relative to a hue value of an indexed color (e.g., hue value of indexed color +/−30).

Figure 7:
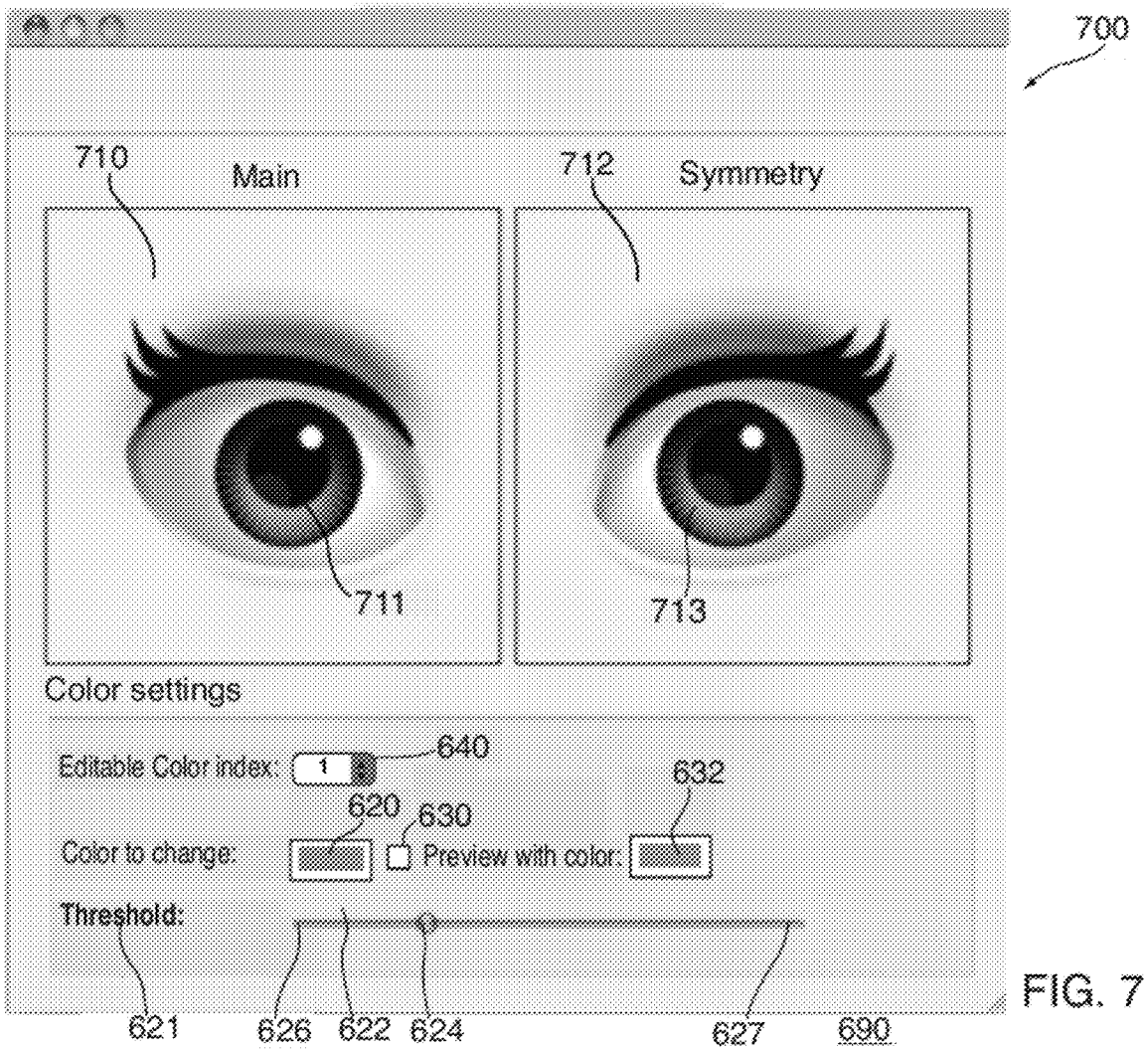
FIG. 7 is an illustrative view of the display of FIG. 6 in which a different color is previewed in accordance with some embodiments of the invention.

Because it may be difficult for an artist to quantify or contemplate a particular magnitude of threshold 621, display 600 can include preview option 630 that can be selected to show the effect of a chosen value of threshold 621 when changing the indexed color of option 620 to a destination color of preview color option 632. In response to the artist selecting preview option 630, electronic 690 device can change the color of the pixels of assets 610 and 612 that have an initial color sufficiently similar to indexed color 620 as determined from the value of threshold 621 (e.g., as set by slider 624), with a replacement color. For example, electronic device 690 can compare the hue values of each pixel of asset 610 and 612 with a range of hue values defined from the hue value of the indexed color of option 620 and from the variation in hue values set by the value of index threshold 621. FIG. 7 is an illustrative view of a display of electronic device 690 that may be substantially similar to display 600, but in which a different color is previewed for the displayed assets in response the selection of preview option 630 in accordance with some embodiments of the invention. For example, display 700 can include assets 710 and 712 having irises 711 and 713 corresponding to the assets and elements of display 600. In display 700, however, the color of the changeable pixels of irises 711 and 713 can be displayed using the preview color set by preview color option 632 (e.g., blue). The preview color of option 632 can differ enough from the indexed color of option 620 such that an artist can determine, after selecting preview option 630, whether the magnitude of index threshold 621 is appropriate (e.g., if slider 624 is at an appropriate position). In particular, the artist can determine whether all of the colors of the pixels of irises 711 and 713 have been changed, and that the colors of pixels other than irises 711 and 713 have not been changed.

In some embodiments, an asset may have a limited number of changeable indexed colors. In one implementation, the encoding model used for the colors of the asset may limit the asset to two or three changeable indexed colors (e.g., the encoding is limited to one or two bits for identifying indexed colors). An artist can set each of the indexed colors using different approaches. For example, display 600 can include color index 640 identifying an indexed color. The color index can serve as a reference for identifying a specific indexed color. The number of color indexes available for an asset (e.g., index 1 and index 2) can be determined from system requirements, such as, for example, the amount of storage or memory allocated for color to each pixel. Each color index can be associated with a different indexed color selectable in option 620, and a different threshold. For example, a green indexed color corresponding to irises 611 and 613 of assets 610 and 612 can be associated with a first color index, and a purple indexed color corresponding to eye shadows 614 and 615 can be associated with a second color index. By selecting the particular indexed colors that can be changed, an artist can indirectly specify specific elements of the asset for which colors can be changeable.

As described above, only some pixels of each asset can be of a color that can change. In particular, only those pixels having an initial color that matches an indexed color, or that are sufficiently similar to an indexed color (as determined by a value of an index threshold associated with the indexed color) may change. It may be necessary, therefore, for an asset to include information identifying each pixel having a color that is changeable. In addition, the asset can include information associating each pixel having a changeable color with a specific indexed color. In particular, each pixel may be associated with an indexed color such that when a user provides an instruction to change a particular indexed color, colors of all pixels associated with the particular indexed color will change.

Any suitable approach can be used to indicate whether or not the color of a pixel of an asset can be changed. In particular, the color encoding model used for each pixel corresponding to a completed asset (e.g., after the artist defines each of the indexed colors and their respective thresholds) can include information indicating whether the color of the pixel, in the initial artist design, falls within a threshold indicating that its color can change for a particular index.

In some embodiments, a red, green, blue, alpha (RGBA) model can be used to encode the pixels of an asset. The RGBA model may be necessary for displaying a pixel due to requirements of a display (e.g., a display component of an electronic device may use red, green and blue light sources to color a pixel). Initially, each pixel of the asset can be encoded using a 32-bit structure. FIG. 8 is a schematic view of an initial illustrative data structure for storing a color of a pixel forming an asset defined by an artist in accordance with some embodiments of the invention. Data structure 800 can include components 810, each of which may be associated with a particular number of bits 820. For example, red or "R" component 812 can include 8 bits 822, green or "G" component 814 can include 8 bits 824, blue or "B" component 816 can include 8 bits 826, and transparency, alpha or "A" component 818 can include 8 bits 828. For example, data structure 800 can be used when the artist initially creates an asset, as it can be directly displayed by a device display (e.g., it is provided using a RGBA model)

To determine which pixels of an asset are changeable, the electronic device may need to convert the RGBA model of the asset to a hue, value, saturation, and transparency model (e.g., a HSVA model). In particular, an electronic device may need to establish a hue value for each pixel, and may use the hue value to determine whether the pixel is within a threshold amount of a selected indexed color (e.g., as discussed above in connection with FIGS. 6 and 7). FIG. 9 is a schematic view of an illustrative converted data structure for storing a color of a pixel in accordance with some embodiments of the invention. Data structure 900 can include components 910, each of which may be associated with a number of bits 920 corresponding to the number of bits of data structure 800 (FIG. 8). For example, hue or "H" component 912 can include 8 bits 922, saturation or "S" component 914 can include 8 bits 924, value or "V" component 916 can include 8 bits 926, and transparency, alpha or "A" component 918 can include 8 bits 928. Using data structure 900, thane electronic device can compare the hue values stored by bits 922 with a range of hue values corresponding to an indexed color and can determine whether a hue value falls within the threshold for the indexed color as previously defined by an artist for the asset.

After comparing hue values for each pixel, an electronic device can store, as part of the model used for encoding each pixel, information indicating whether the pixel color is changeable. FIG. 10 is a schematic view of an illustrative data structure that may have a color index in accordance with some embodiments of the invention. Data structure 1000 can include components 1010, each of which may be associated with a number of bits 1020. In the example of data structure 1000, however, the number of bits provided can be less than the initial number of bits 820 of structure 800 (FIG. 8). In particular, data structure 1000 can instead have 24 bits (e.g., 8 fewer bits). For example, red or "R" component 1012 can include 5 bits 1022, green component 1014 can include 6 bits 1024, blue or "B" component 1016 can include 5 bits 1026, and transparency, alpha or "A" component 1018 can include 6 bits 1028. The electronic device can define data structure 1000 using various different approaches. In some cases, the electronic device can convert the HSVA model of data structure 900 to a RGBA model. Alternatively, the electronic device can retrieve the initial RGBA model of data structure 800 corresponding to a HSVA model of data structure 900, and reduce the number of bits stored in data structure 800 to form data structure 1000. For example, the electronic device can identify and drop less significant bits of data structure 800 or data structure 900.

Data structure 1000 can also include color index component 1019 that may have 2 bits 1029, which can be used to indicate whether the pixel is changeable. The bits used for color index component 1019 can include the least significant bits of other components of the data structure (e.g., one bit each from red component 1012 and from blue component 1016). Color index component 1019 can identify the particular indexed colors with which the pixel corresponds (e.g., the pixel color changes when a user selects the particular indexed color).

The different values for bits 1029 of color index components 1029 can have any suitable meaning. FIG. 11 is an illustrative table indicating the meaning of color index values in accordance with some embodiments of the invention. Table 1100 can include column 1110 of bit values, and column 1120 of corresponding meanings. In the example of table 1100, the color index has 2 bits, and therefore four possible values. A 0 0 color index value 1112 may correspond to meaning 1122 indicating that the pixel color may not be editable (e.g., the pixel color was out of the threshold associated with each of the indexed colors associated with the asset). A 0 1 color index value 1114 may correspond to meaning 1124 indicating that the pixel color may be edited when a first indexed color is selected (e.g., when a color corresponding to a first color index 640, FIG. 6, is changed). A 1 0 color index value 1116 may correspond to meaning 1126 indicating that the pixel color may be edited when a second indexed color is selected (e.g., when a color corresponding to a second color index 640 is changed). A 1 1 color index value 1118 may correspond to meaning 1128 indicating that the pixel color corresponds to a skin color of the asset or of an avatar. This color index may be necessary to ensure that assets of an avatar have a consistent skin tone. In some cases, the 1 1 color index can correspond to a dominant color theme used in several assets of an avatar, and can be used to ensure that all of the assets have a consistent color on the avatar.

Each pixel of an asset used in an avatar can be stored using a data structure such as data structure 1000 of FIG. 10. In particular, the data structure can include a color index that may indicate whether a color is changeable, and that may identify each of the one or more the specific indexed colors that must be selected to change the pixel color. The color index of the data structure can then be used when a user provides an instruction to change a pixel color of the asset.

To change an indexed color of an asset, a user may select one of the indexed colors of the asset, and select a destination color to replace the selected indexed color. For example, as shown in the example of FIG. 1, the user can select one of indexed color options 130 and 132, and can select a destination color (e.g., from menu 140). In some cases, a user may instead select an initial color that previously replaced an indexed color. In such cases, the initial color may be represented in one of color options 130 and 132. It will be understood in the following discussion, therefore, that an indexed color can instead be an initial color that replaced an indexed color. In response to receiving an instruction to change an indexed color, the electronic device can identify the particular pixels encoded with a color index corresponding to the indexed color of the selected option and its associated threshold value. In this manner, the electronic device can identify the specific pixels to be changed.

Once the pixels to be changed have been identified for a selected indexed color, the electronic device can identify replacement colors to use for the identified pixels based on the destination color. The replacement colors can include several different colors that are similar to the destination color, but that include variations or gradients as provided by the initial colors of the identified pixels of the asset. The electronic device can define replacement colors for each identified pixel using any suitable approach. In some embodiments, the electronic device can define replacement values for one or more of hue, saturation, value, and transparency (e.g., alpha) based on initial values for a particular pixel and on corresponding values associated with the destination color. FIG. 12 is an illustrative equation that may be used to define replacement colors for pixels having a changeable color in accordance with some embodiments of the invention. Equation 1200 can define replacement values for hue, saturation, and value for each changeable pixel. The transparency, or alpha, can remain the same when a pixel color is changed. In particular, equation 1200 can define values based on initial saturation Sp, and initial value Vp, as well as destination hue Hd, destination saturation Sd, and destination value Vd. For example, the replacement hue can be Hd, the replacement saturation can be Sp*Sd, and the replacement value can be Sp*(Vp*Vd)+(1−Sp)*Vp. In some cases, the particular calculation used for the replacement values can be tuned based on the type of asset displayed, or for a specific type of avatar.

Figures 13, 14A, 14B:
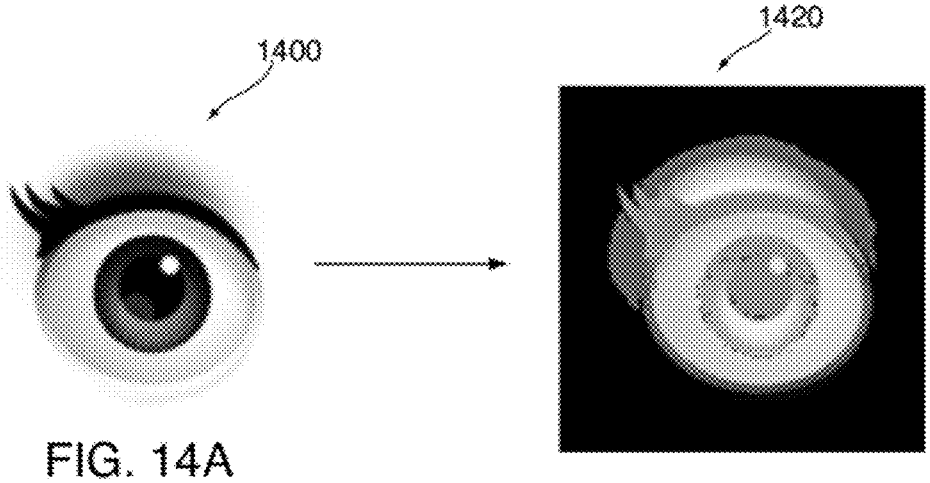
FIG. 13 is a schematic view of an illustrative data structure having a color index in accordance with some embodiments of the invention.
FIGS. 14A and 14B are illustrative views of an asset and its pre-processed representation in accordance with some embodiments of the invention.

When an equation similar to equation 1200 is used to define replacement colors, an electronic device may require, for each identified pixel, a model of the pixel that includes values for its Sp and Vp. Accordingly, it may be desirable to generate and store, for each identified pixel, a data structure that may pre-emotively store at least saturation and value information that may be used to generate replacement colors. FIG. 13 is a schematic view of an illustrative processed data structure having a color index in accordance with some embodiments of the invention. Data structure 1300 can include components 1310, each of which may be associated with a number of bits 1320, where the components may correspond to a processed value, alpha, and saturation (e.g., VAS) model. Data structure 1300 can include all of the information required for each pixel to be changed to a new color. For example, value or "V" component 1312 can include 8 bits 1322, transparency, alpha or A component 1314 can include 8 bits 1324, saturation or "S" component 1316 can include 6 bits 1326, and color index 1318 can include 2 bits 1328. Data structure 1300 may not include a hue component, as the hue for the replacement color can be determined directly from the hue of a selected destination color (e.g., in equation 1200, the replacement hue H is the same as the destination hue Hd). Data structure 1300 can be defined by converting any suitable structure including, for example, a RGBA model of data structure 1000 (FIG. 10), or a RGBA model of data structure 800 (FIG. 8).

Data structure 1300 may have any suitable size. For example, the number of bits provided can correspond to the number bits of data structure 1000 (FIG. 10). In particular, data structure 1300 can have 24 bits (e.g., 8 fewer bits than data structures 800 of FIGS. 8 and 900 of FIG. 9). Although data structure 1300 can be smaller than data structure 800 and/or data structure 900, data structure 1300 can include the same amount of color information as the larger data structures. This is because the hue information not present in data structure 1300 may be provided from the hue of a destination color selected by a user, as discussed above.

From the information of data structure 1300 and from a destination color, an electronic device can define, for each of the identified pixels to change, replacement values of a HSVA model using any suitable equation, such as equation 1200. The electronic device can then convert the replacement values of a HSVA model to a replacement RGBA model (not shown) for display by the device (e.g., when a HSVA model cannot be directly displayed by the device).

The conversion from an RGBA model to a HSVA model can be expensive with respect to device resources (e.g., memory, processing, power, and time). Accordingly, it may be desirable to reduce the processing required for changing colors by preemptively calculating a processed VAS model for pixels having a color index indicating that the color can change (e.g., by preemptively calculating values for data structure 1300, FIG. 12 for pixels having a color index value of "0 1" or "1 0"). FIGS. 14A and 14B are illustrative views of an asset and its pre-processed representation in accordance with some embodiments of the invention. Asset 1400 can be encoded using any suitable model including, for example, a RGBA model. In some cases, asset 1400 can be encoded using a RGBA model having color index information. When processed to define saturation, value, and transparency components used to change colors, asset 1400 can be represented in form 1420, but it may never be displayed as such by the device to a user (e.g., form 1420 may correspond to a visual representation of the asset stored in data structure 1300). The electronic device can then store, for each asset, a standard RGBA model for every pixel of the asset (e.g., with or without a color index), and a processed VAS model for those pixels having a color index indicative of a changeable color.

Figure 15:
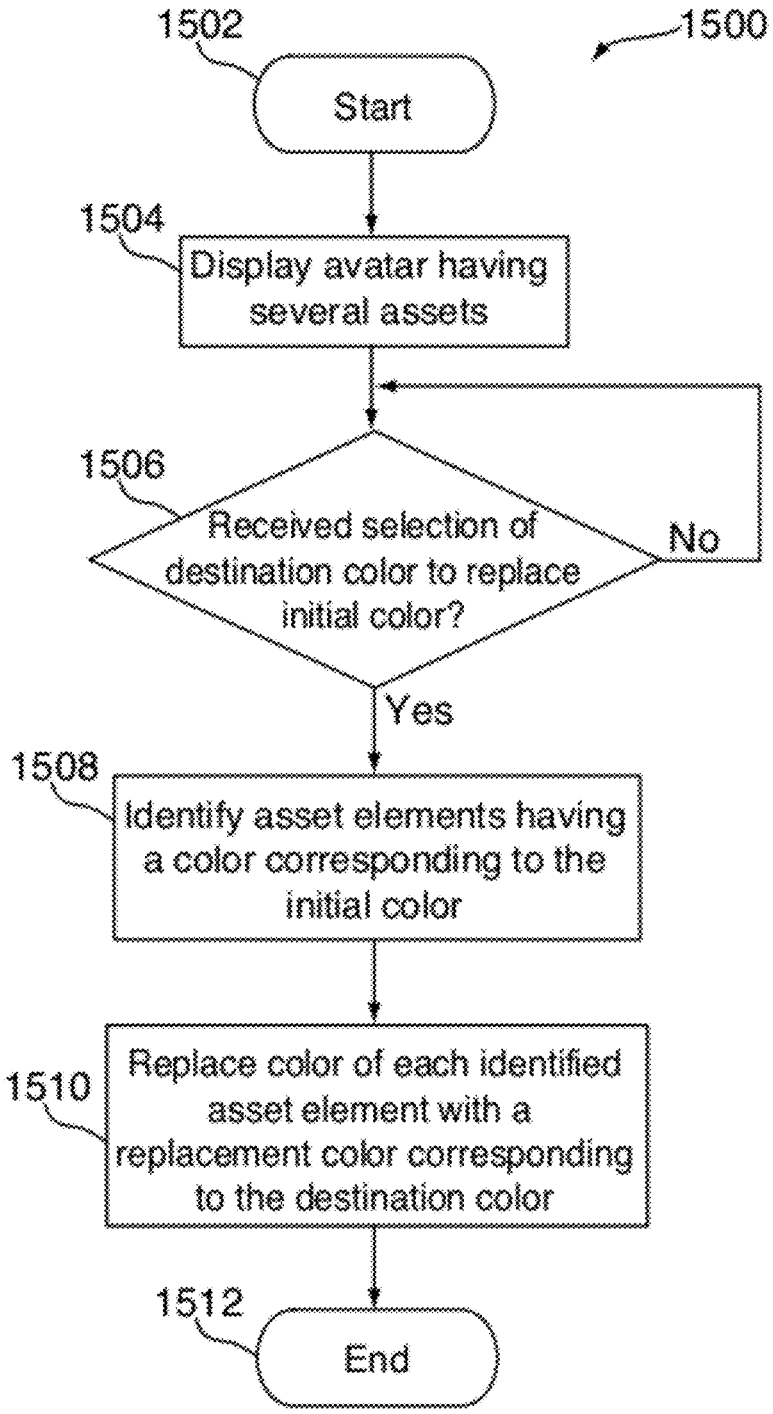
FIG. 15 is a flowchart of an illustrative process for changing a color of a displayed asset forming part of an avatar in accordance with some embodiments of the invention.

FIG. 15 is a flowchart of an illustrative process for changing a color of a displayed asset forming part of an avatar in accordance with some embodiments of the invention. Process 1500 can begin at step 1502. At step 1504, an electronic device can display an avatar having several assets. In particular, the avatar can be constructed by combining different assets representing attributes of the avatar (e.g., facial attributes). At step 1506, the electronic device can determine whether a selection of a destination color to replace an initial color of an asset element was received. For example, the electronic device can determine whether a user provided a selection of an asset, an initial color, and a destination color. If the electronic device determines that no selection of a destination color was received, process 1500 can return to step 1506. If, at step 1506, the electronic device instead determines that a selection of a destination color was received, process 1500 can move to step 1508. At step 1508, the electronic device can identify elements of the asset that have a color corresponding to the selected initial color. For example, the electronic device can identify asset elements that have a hue within a range defined by a threshold value of the initial color (e.g., a threshold value of a hue of the initial color). At step 1510, the electronic device can replace the color of each of the identified elements of the asset with a replacement color. For example, the electronic device can define replacement values of a color model that may be used for the identified elements (e.g., a model that may change a hue, saturation, and value for each identified element). The replacement values may be determined from values corresponding to a color model of the destination color. In some cases, the electronic device can convert a model used to define the replacement color for an asset element (e.g., a HSV model) to a model appropriate for display of the asset element (e.g., a RGB model). Process 1500 can then end at step 1512.

Figure 16:
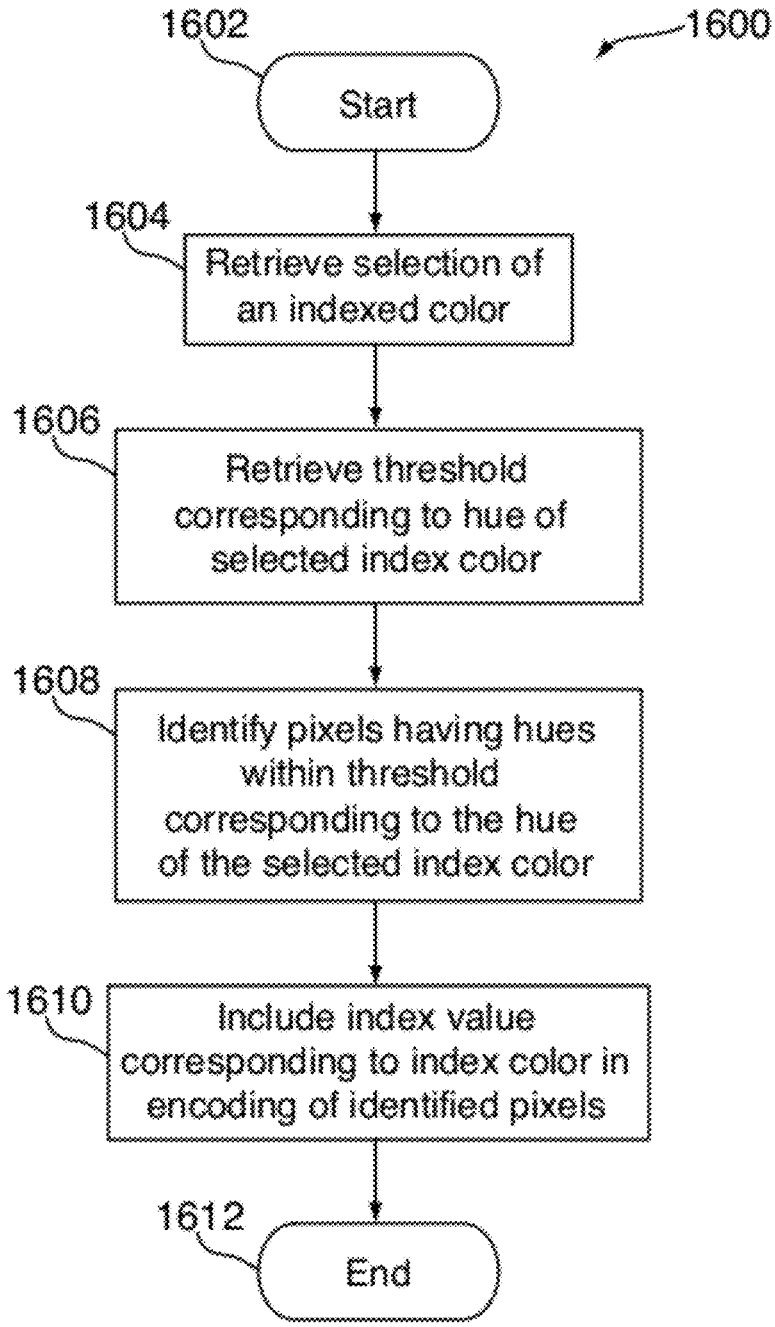
FIG. 16 is a flowchart of an illustrative process for identifying elements of an asset having a changeable color in accordance with some embodiments of the invention.

FIG. 16 is a flowchart of an illustrative process for identifying elements of an asset having a changeable color in accordance with some embodiments of the invention. Process 1600 can begin at step 1602. At step 1604, the electronic device can receive a selection of an indexed color. For example, an artist can indicate a particular indexed color for a defined asset to the electronic device. At step 1606, the electronic device can retrieve a threshold corresponding to a hue of the selected indexed color. For example, the artist can define a threshold defining a similarity range with respect to the hue of the indexed color (e.g., how close other colors appear relative to the indexed color). At step 1608, the electronic device can identify pixels of an asset having a hue within the threshold amount of the hue of the indexed color. For example, the electronic device can identify individual pixels of an asset defined by an artist that have a color similar to the indexed color (e.g., as determined from the hue of each pixel). In some cases, the electronic device can convert an encoding used for each pixel from a RGB model to a HSV model so that hues associated with each pixel can be compared to the hue of the indexed color. At step 1610, the electronic device can include an index value corresponding to the indexed color in an encoding used for each of the identified pixels. For example the model used to encode each pixel can include any suitable number of bits (e.g., two color index bits) that may indicate whether the color of the pixel may change, and, if so, each of the indexed colors based on which the color of the pixel may change. Process 1600 can end at step 1612.

Figure 17:
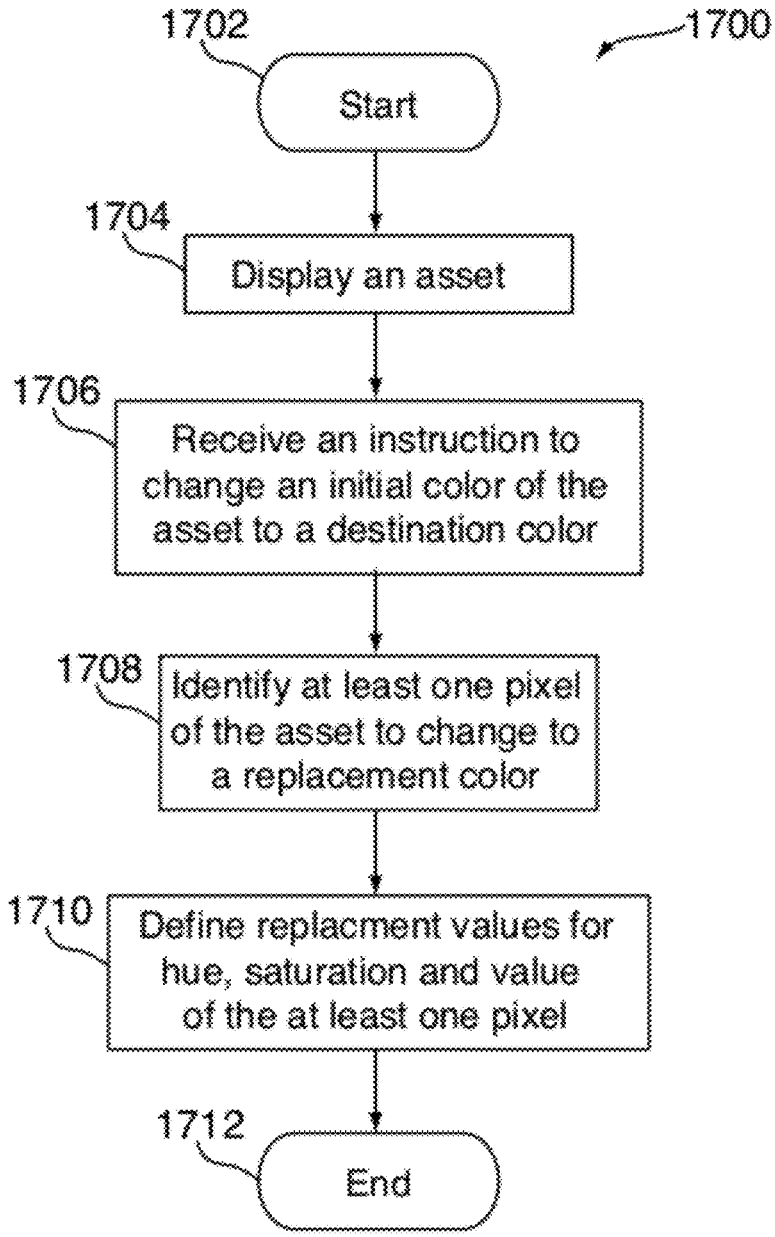
FIG. 17 is a flowchart of an illustrative process for changing a color of a displayed asset in accordance with some embodiments of the invention.

FIG. 17 is a flowchart of an illustrative process for changing a color of a displayed asset in accordance with some embodiments of the invention. Process 1700 can begin at step 1702. At step 1704, an electronic device can display an asset, for example as part of an avatar. At step 1706, the electronic device can receive an instruction to change a color of the asset to a destination color. For example, a user can select an initial color (e.g., an indexed color) and a new, destination color to replace the initial color. At step 1708, the electronic device can identify at least one pixel of the asset to change to a replacement color corresponding to the destination color. Each identified pixel can be associated with a color index corresponding to the color to change (e.g., to the initial color). At step 1710, the electronic device can define a replacement value for a hue, saturation and value of the identified pixel (e.g., components of a HSV model). The replacement values can be calculated from corresponding components of the initial color of the pixel (e.g., from a hue, saturation and value of the initial color) and from corresponding components of the replacement color (e.g., from a hue, saturation and value of the replacement color). Process 1700 can then end at step 1712.

Figure 18:
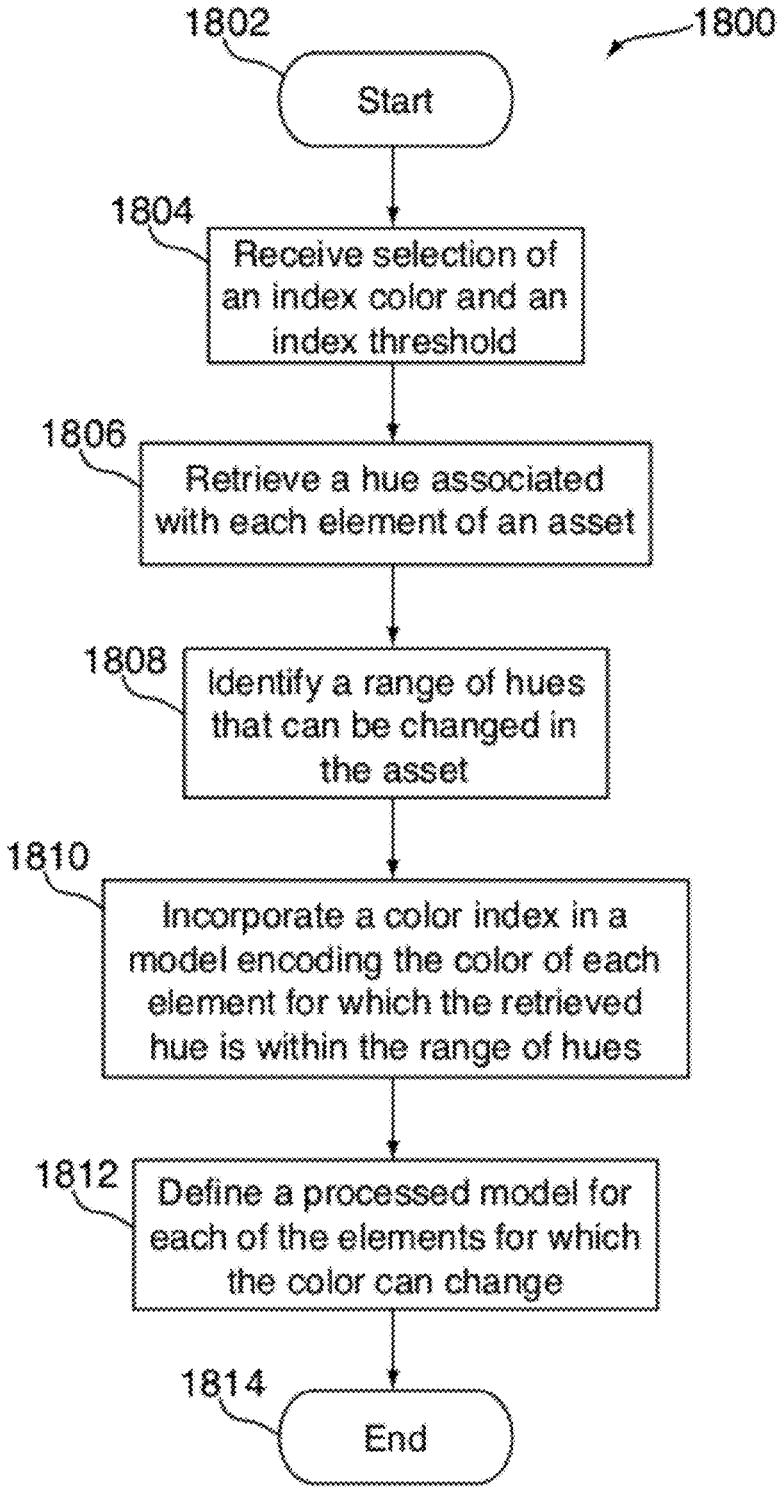
FIG. 18 is a flowchart of an illustrative process for processing an asset for which a color can be changed in accordance with some embodiments of the invention.

FIG. 18 is a flowchart of an illustrative process for processing an asset for which a color can be changed in accordance with some embodiments of the invention. Process 1800 can begin at step 1802. At step 1804, the electronic device can retrieve an indexed color of a displayed asset and an index threshold associated with the indexed color. The indexed color can be changed in the displayed asset. At step 1806, the electronic device can retrieve a hue associated with each element of the asset. At step 1808, the electronic device can identify, from a hue of the indexed color and from the index threshold, a range of hues that can be changed in the asset. At step 1810, the electronic device can incorporate a color index in a model encoding the color of each element for which the retrieved hue is within the range of hues. The color index can indicate that the color of the element can change. At step 1812, the electronic device can define a processed model for each of the elements for which the color can change. The components of the processed model can be used to define a replacement color of the element (e.g., components of data structure 1300, FIG. 13). Process 1800 can then end at step 1814.

Figure 19:
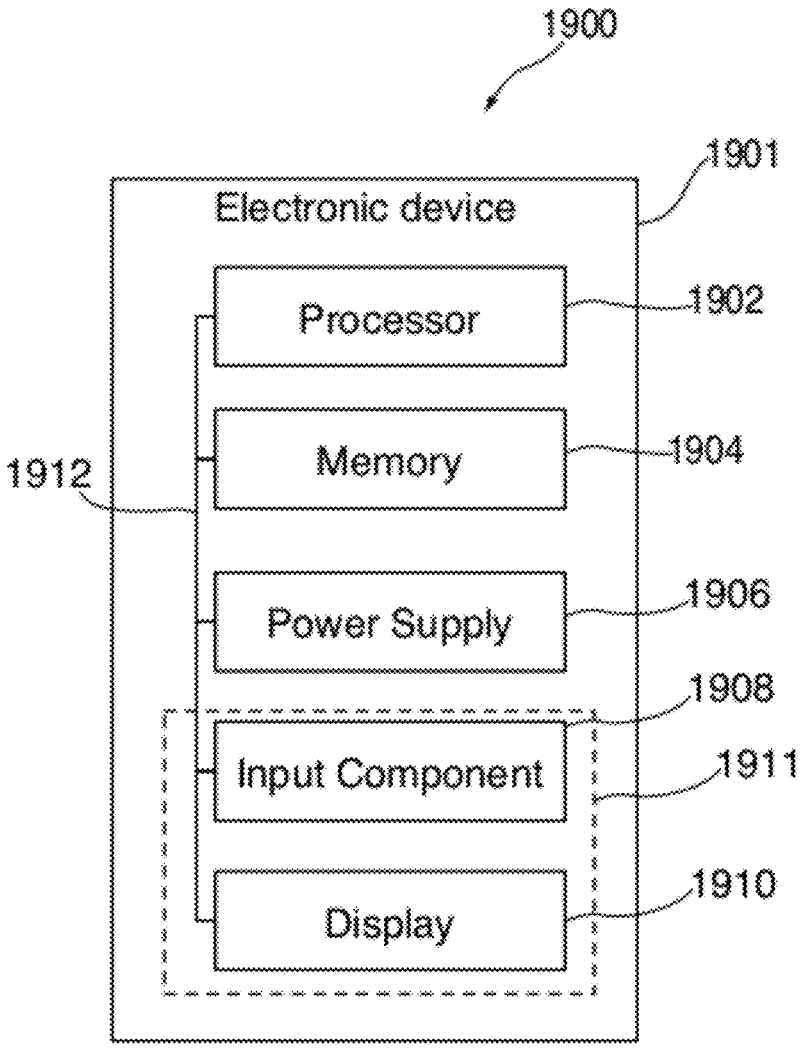
FIG. 19 is a schematic view of an illustrative electronic device for displaying an avatar in accordance with some embodiments of the invention.

Any suitable electronic device can be used to define assets for an avatar, or to display an avatar having assets for which a color can be changed. FIG. 19 is a schematic view of an illustrative electronic device 1900 for allowing an artist to define assets of an avatar and for displaying an avatar to a user in accordance with some embodiments of the invention. Electronic device 1900 may be any portable, mobile, or hand-held electronic device configured to present an avatar or an asset to a user wherever the user travels. Alternatively, electronic device 1900 may not be portable at all, but may instead be generally stationary. Electronic device 1900 can include, but is not limited to, a music player (e.g., an iPod™ available by Apple Inc. of Cupertino, Calif.), video player, still image player, game player, other media player, music recorder, movie or video camera or recorder, still camera, other media recorder, radio, medical equipment, domestic appliance, transportation vehicle instrument, musical instrument, calculator, cellular telephone (e.g., an iPhone™ available by Apple Inc.), other wireless communication device, personal digital assistant, remote control, pager, computer (e.g., a desktop, laptop, tablet, server, etc.), monitor, television, stereo equipment, set up box, set-top box, boom box, modem, router, printer, and combinations thereof. In some embodiments, electronic device 1900 may perform a single function (e.g., a device dedicated to presenting visual content) and, in other embodiments, electronic device 1900 may perform multiple functions (e.g., a device that presents visual content, plays music, and receives and transmits telephone calls).

Electronic device 1900 may include a processor 1902, memory 1904, power supply 1906, input component 1908, and display 1910. Electronic device 1900 may also include a bus 1912 that may provide one or more wired or wireless communication links or paths for transferring data and/or power to, from, or between various other components of device 1900. In some embodiments, one or more components of electronic device 1900 may be combined or omitted. Moreover, electronic device 1900 may include other components not combined or included in FIG. 19 and/or several instances of one or more of the components shown in FIG. 19.

Memory 1904 may include one or more storage mediums, including for example, a hard-drive, flash memory, non-volatile memory, permanent memory such as read-only memory ("ROM"), semi-permanent memory such as random access memory ("RAM"), any other suitable type of storage component, or any combination thereof. Memory 1904 may include cache memory, which may be one or more different types of memory used for temporarily storing data for electronic device application programs. Memory 1904 may store media data (e.g., music and image files), software (e.g., a boot loader program, one or more application programs of an operating system for implementing functions on device 1900, etc.), firmware, preference information (e.g., media playback preferences), lifestyle information (e.g., food preferences), exercise information (e.g., information obtained by exercise monitoring equipment), transaction information (e.g., information such as credit card information), wireless connection information (e.g., information that may enable device 1900 to establish a wireless connection), subscription information (e.g., information that keeps track of podcasts or television shows or other media a user subscribes to), contact information (e.g., telephone numbers and e-mail addresses), calendar information, any other suitable data, or any combination thereof.

Power supply 1906 may provide power to one or more of the components of device 1900. In some embodiments, power supply 1906 can be coupled to a power grid (e.g., when device 1900 is not a portable device, such as a desktop computer). In some embodiments, power supply 1906 can include one or more batteries for providing power (e.g., when device 1900 is a portable device, such as a cellular telephone). As another example, power supply 1906 can be configured to generate power from a natural source (e.g., solar power using solar cells).

One or more input components 1908 may be provided to permit a user to interact or interface with device 1900. For example, input component 1908 can take a variety of forms, including, but not limited to, an electronic device pad, dial, click wheel, scroll wheel, touch screen, one or more buttons (e.g., a keyboard), mouse, joy stick, track ball, microphone, camera, proximity sensor, light detector, and combinations thereof. Each input component 1908 can be configured to provide one or more dedicated control functions for making selections or issuing commands associated with operating device 1900.

Electronic device 1900 may also include one or more output components that may present information (e.g., visual, audible, and/or tactile information) to a user of device 1900. An output component of electronic device 1900 may take various forms, including, but not limited to, audio speakers, headphones, audio line-outs, visual displays, antennas, infrared ports, rumblers, vibrators, or combinations thereof.

For example, electronic device 1900 may include display 1910 as an output component. Display 1910 may include any suitable type of display or interface for presenting visual content to a user. In some embodiments, display 1910 may include a display embedded in device 1900 or coupled to device 1900 (e.g., a removable display). Display 1910 may include, for example, a liquid crystal display ("LCD"), a light emitting diode ("LED") display, an organic light-emitting diode ("OLED") display, a surface-conduction electron-emitter display ("SED"), a carbon nanotube display, a nanocrystal display, any other suitable type of display, or combination thereof. Alternatively, display 1910 can include a movable display or a projecting system for providing a display of content on a surface remote from electronic device 1900, such as, for example, a video projector, a head-up display, or a three-dimensional (e.g., holographic) display. As another example, display 1910 may include a digital or mechanical viewfinder, such as a viewfinder of the type found in compact digital cameras, reflex cameras, or any other suitable still or video camera. In some embodiments, display 1910 may include display driver circuitry, circuitry for driving display drivers, or both. Display 1910 can be operative to present visual content provided by device 1900 (e.g., an avatar constructed from several assets).

It should be noted that one or more input components and one or more output components may sometimes be referred to collectively herein as an input/output ("I/O") interface (e.g., input component 1908 and display 1910 as I/O interface 1911). It should also be noted that input component 1910 and display 1910 may sometimes be a single I/O component, such as a touch screen that may receive input information through a user's touch of a display screen and that may also provide visual information to a user via that same display screen.

Electronic device 1900 may also be provided with an enclosure or housing 1901 that may at least partially enclose one or more of the components of device 1900 for protecting them from debris and other degrading forces external to device 1900. In some embodiments, one or more of the components may be provided within its own housing (e.g., input component 1908 may be an independent keyboard or mouse within its own housing that may wirelessly or through a wire communicate with processor 1902, which may be provided within its own housing).

Processor 1902 of device 1900 may include any processing or control circuitry operative to control the operations and performance of one or more components of electronic device 1900. For example, processor 1902 may be used to run operating system applications, firmware applications, media playback applications, media editing applications, or any other application. In some embodiments, processor 1902 may receive input signals from input component 1908 and/or drive output signals through display 1910.

It is to be understood that the steps shown in each one of processes 1500-1800 of FIGS. 15-18, respectively, are merely illustrative and that existing steps may be modified or omitted, additional steps may be added, and the order of certain steps may be altered.

Moreover, the processes described with respect to FIGS. 15-18, as well as any other aspects of the invention, may each be implemented in hardware or a combination of hardware and software. Embodiments of the invention can also be embodied as computer readable code on a computer readable medium. The computer readable medium may be any data storage device that can store data which can thereafter be read by a computer system. Examples of the computer readable medium include read-only memory ("ROM"), random-access memory ("RAM"), CD-ROMs, DVDs, magnetic tape, and optical data storage devices. The computer readable medium can also be distributed over network-coupled computer systems so that the computer readable code may be stored and executed in a distributed fashion.

Although many of the embodiments of the present invention are described herein with respect to personal computing devices, it should be understood that the present invention is not limited to personal computing applications, but is generally applicable to other applications.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The above-described embodiments of the invention are presented for purposes of illustration and not of limitation.

What is claimed is:

1. A method for changing a color of an asset that comprises a plurality of colors, the method comprising:

displaying an asset comprising a plurality of colors;

receiving a selection of an indexed color associated with the asset;

receiving a selection of a threshold corresponding to a range of colors relative to the indexed color;

receiving an instruction to change one of the plurality of colors to a destination color;

identifying at least one pixel of the asset to change from an initial color to a replacement color, wherein the at least one pixel is associated with the indexed color index corresponding to the one of the plurality of colors;

defining replacement values for a hue, saturation, and value of the at least one pixel corresponding to the replacement color, wherein the replacement values are defined from a model of the initial color and from a model of the destination color;

determining whether an initial color associated with each of the asset's other pixels is within the range of colors for the indexed color; and modifying, for each of the asset's other pixels determined to have an initial color within the range of colors for the indexed color, an encoding of the pixel to replace at least one least significant bit with a color index to indicate that the color of the pixel is changeable.

2. The method of claim 1, wherein:

the model of the initial color comprises at least one of a hue, saturation, and value of the initial color; and the model of the replacement color comprises at least one of a hue, saturation and value.

3. The method of claim 1, further comprising:

pre-processing the asset to define, for the at least one pixel, the model of the initial color.

4. The method of claim 1, further comprising:

identifying a plurality of pixels defining an initial color gradient based on the initial color; and determining a replacement color for each of the plurality of pixels defining a replacement color gradient based on the destination color.

5. The method of claim 1, further comprising:

converting the defined replacement values for the hue, saturation and value of the at least one pixel to a red, green, blue (RGB) model for display.

6. The method of claim 1, further comprising:

displaying an avatar, wherein the avatar comprises a plurality of assets comprising the asset.

7. An electronic device, comprising control circuitry operative to:

receive a selection of an indexed color associated with an asset;

receive a selection of a threshold corresponding to a range of colors relative to the indexed color;

determine, for each pixel of the asset, whether an initial color associated with the pixel is within the range of colors for the indexed color; and in response to determining that the initial color associated with a pixel is within the range of colors, modify an encoding of the pixel to replace at least one least significant bit with a color index indicating that the color of the pixel is changeable.

8. The electronic device of claim 7, wherein the control circuitry is further operative to:

identify a hue of the indexed color;

define a range of hues corresponding to the threshold;

retrieve, for each pixel of the asset, a color model that includes hue, saturation, and value; and compare the hue of each pixel with the defined range of hues to determine whether the color of the pixel is changeable.

9. The electronic device of claim 8, wherein the control circuitry is further operative to:

retrieve the asset encoded using an initial red, green, blue (RGB) model; and convert an encoding of the asset to a hue, value, saturation (HSV) model.

10. The electronic device of claim 9, wherein the control circuitry is further operative to:

convert the encoding of the asset back to a processed RGB model that comprises the color index, wherein the color index comprises two bits, and wherein at least one of the red, green, and blue components of the processed RGB model comprises one less bit than in components of the initial RGB model.

11. The electronic device of claim 9, wherein the control circuitry is further operative to:

store the initial RGB model using 32 bits; and store the HSV model using 24 bits.

12. The electronic device of claim 7, wherein the color index indicates one of:

the color of the pixel is changeable relative to a first indexed color;

the color of the pixel is changeable relative to a second indexed color;

the color of the pixel is changeable relative to a skin color; and the color of the pixel is not changeable.

13. The electronic device of claim 7, wherein the control circuitry is further operative to:

identify a set of pixels comprising each pixel of the asset having a color index indicating that the color of the pixel is changeable; and process each pixel of the identified set of pixels to convert an encoding of the pixels to a model comprising components used to define a replacement color for the pixels.

14. The electronic device of claim 13, wherein the control circuitry is further operative to:

convert the encoding of each pixel of the identified set of pixels to a model that comprises components for value, transparency, and saturation.

15. A method for processing an asset used as part of an avatar, the asset comprising a plurality of elements for which a color can be changed, the method comprising:

retrieving an indexed color and an index threshold associated with the indexed color;

retrieving a hue associated with each element of the plurality of elements of the asset;

identifying, from a hue of the indexed color and from the index threshold, a range of hues that are changeable in the asset;

modifying, for incorporating a color index in a model encoding the color of each element for which the retrieved hue is within the range of hues, an encoding of the element to replace at least one least significant bit with a color index, wherein the color index indicates that the color of the element that is changeable; and defining a processed model for each of the elements for which the color of the element is changeable, wherein components of the processed model are used to define a replacement color for the element.

16. The method of claim 15, further comprising:

converting an initial red, green, blue (RGB) model of each element of the plurality of elements of the asset to a hue, value, saturation (HSV) model of the elements.

17. The method of claim 16, further comprising:

modifying the initial RGB model to a processed RGB model, wherein at least one least significant bit of the initial RGB model is replaced with color index information in the processed RGB model.

18. The method of claim 15, further comprising:

receiving an instruction to change the indexed color to a replacement color;

identify the set of elements comprising each element for which the color index indicates that the color of the element is changeable; and defining a replacement model for encoding a replacement color for each element of the identified ser elements, wherein components of the replacement model are defined using the components of the processed model.

19. The method of claim 18, wherein:

the components of the processed model comprise at least one of a value, transparency, and saturation component.

20. A non-transitory computer-readable medium for changing a color of a displayed asset, the non-transitory computer readable medium comprising computer program logic recorded thereon for:

displaying an asset comprising a plurality of colors;

receiving a selection of an indexed color associated with the asset;

receiving a selection of a threshold corresponding to a range of colors relative to the indexed color;

receiving an instruction to change one indexed color of the plurality of colors of the asset to a destination color;

identifying at least one pixel of the asset to change from an initial color to a replacement color, wherein the initial color of the at least one pixel is associated with a color index corresponding to the indexed color;

defining replacement values for a hue, saturation, and value of the at least one pixel corresponding to the replacement color, wherein the replacement values are calculated from a model of the initial color and from a model of the destination color;

determining whether an initial color associated with each of the asset's other pixels is within the range of colors for the indexed color; and modifying, for each of the asset's other pixels determined to have an initial color within the range of colors for the indexed color, an encoding of the pixel to replace at least one least significant bit with a color index to indicate that the color of the pixel is changeable.

* * * * *

UNITED STATES PATENT AND TRADEMARK OFFICE

CERTIFICATE OF CORRECTION

PATENT NO. : 8,558,844 B2
APPLICATION NO. : 12/892624
DATED : October 15, 2013
INVENTOR(S) : Goossens It is certified that error appears in the above-identified patent and that said Letters Patent is hereby corrected as shown below:

On the title page, item [57], replace the words “an destination color” with --a destination color--.

In the Claims

Column 17, line 14, claim 9 “value, saturation” should be changed to --saturation, value--.

Column 18, line 6, claim 15 delete the word “that”.

Column 18, line 14, claim 17 “value, saturation” should be changed to --saturation, value--.

Column 18, line 23, claim 18 replace the word “identify” with --identifying--.

Column 18, line 27, claim 18 replace the word “ser” with --set of--.

Signed and Sealed this
Twenty-sixth Day of November, 2013

Margaret A. Focarino

Margaret A. Focarino
*Commissioner for Patents of the United States Patent and Trademark Office*